United States Patent [19]

Ohtsuki et al.

[11] 4,402,261

[45] Sep. 6, 1983

[54] SMALL IMPACT PRINTER WITH HAMMER MASK

[75] Inventors: Chihiro Ohtsuki; Hitoshi Mikoshiba, both of Shiojiri, Japan

[73] Assignee: Kabushiki Kaisha Suwa Seikosha, Tokyo, Japan

[21] Appl. No.: 241,330

[22] Filed: Mar. 6, 1981

[30] Foreign Application Priority Data

Mar. 6, 1980 [JP] Japan ..... 55/28466
Mar. 6, 1980 [JP] Japan ..... 55/28467

[51] Int. Cl.[3] ..... B41J 9/02

[52] U.S. Cl. ..... 101/93.29; 101/103; 101/110

[58] Field of Search ..... 101/93.03, 93.09, 93.16, 101/93.21, 93.28–93.34, 93.48, 110, 103; 400/248, 568

[56] References Cited

U.S. PATENT DOCUMENTS 3,414,107 12/1968 Sievers ..... 101/66 X
3,874,285 4/1975 Kodaira et al. ..... 101/93.28
3,954,054 5/1976 Busch ..... 101/110 X
4,250,807 2/1981 Kondo et al. ..... 101/93.48 X
4,311,401 1/1982 Hiki et al. ..... 101/336 X

FOREIGN PATENT DOCUMENTS 1210225 2/1966 Fed. Rep. of Germany .

OTHER PUBLICATIONS

Howard, IBM Tech. Discl. Bulletin, vol. 20, No. 11A, Apr. 1978, pp. 4318–4319.

*Primary Examiner*—Edward M. Coven

[57] ABSTRACT

A printer mask has spaced openings to allow impact therethrough of a hammer against characters arranged in circular columns along a character drum. The distance between the characters and mask changes automatically to compensate for changes in ambient temperature by using mounting materials of selected thermal coefficients of expansion. Uniform printing quality without marring the print paper is achieved with this mask construction.

18 Claims, 15 Drawing Figures

FIG. 1
PRIOR ART
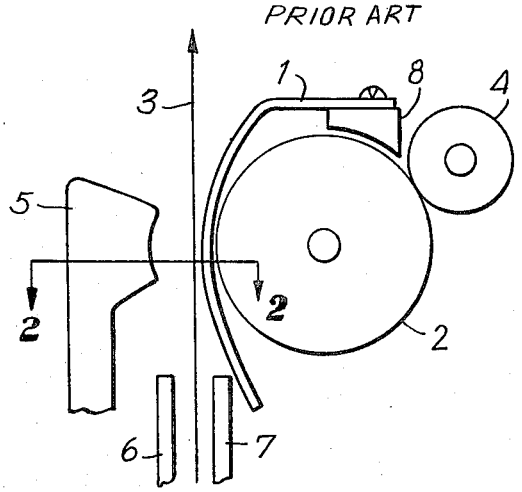
FIG. 2
PRIOR ART
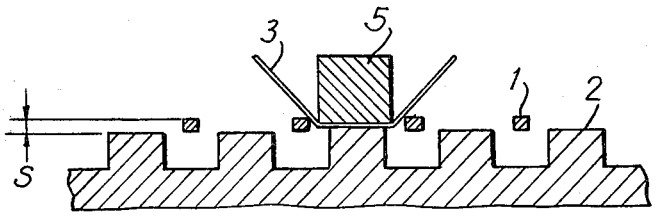
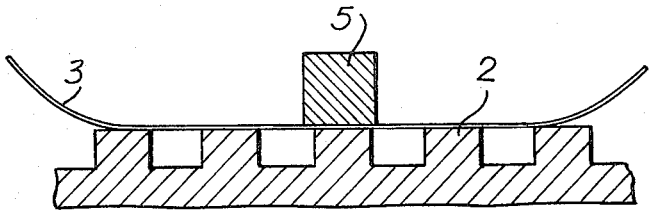
FIG. 3
PRIOR ART FIG.6
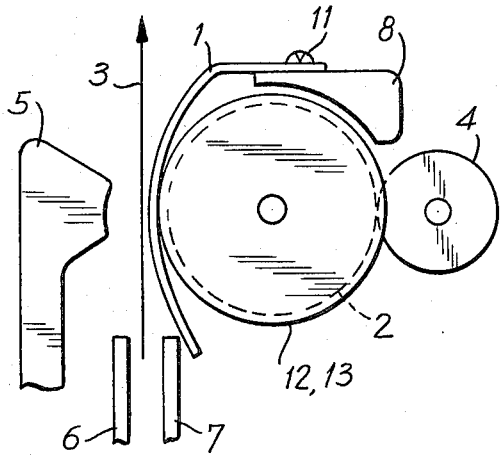
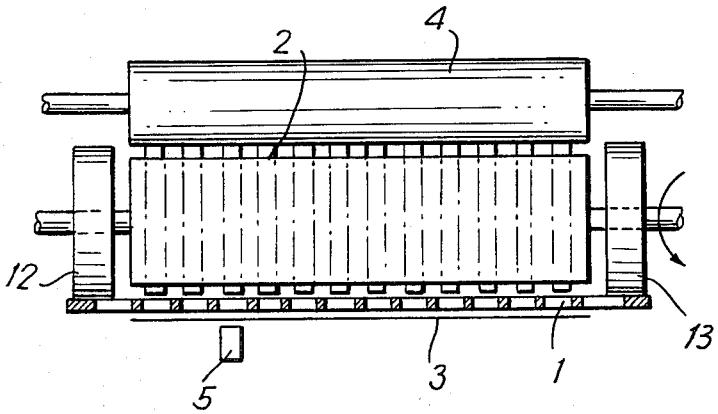
FIG.7

FIG. 11
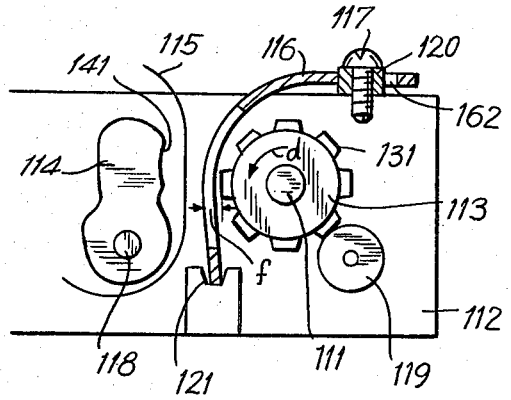
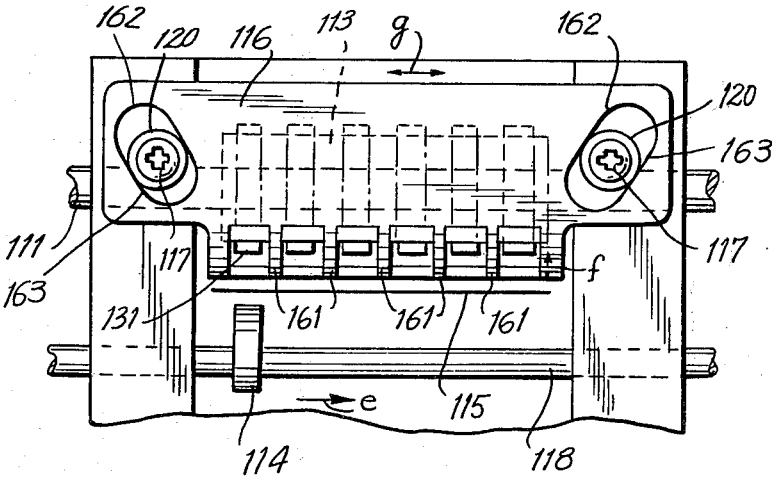
FIG. 12

SMALL IMPACT PRINTER WITH HAMMER MASK

BACKGROUND OF THE INVENTION

This invention relates generally to an impact printer of the type having a character drum with a plurality of columns of characters around the periphery thereof and more particularly to an impact printer having a mask through which a hammer strikes selected characters on the drum. The mask presents a bar between each column on the drum and is positioned between the drum and a print media, for example, paper. In the conventional manner, the paper is positioned between the mask and the hammer which strikes against the character drum through the paper and the opening in the mask. Conventionally, the mask is fixed to the printer frame by means of screws or other similar fasteners. When the diameter of the character drum changes due to changes in ambient temperature, the distance between the characters on the drum and the mask changes such that the spacing becomes more or less whereby the paper may become marred or dirty during printing and the characters may be too light or too dark. In the prior art, masks have been made using two kinds of metal in a bimetal arrangement so that the mask bends with changes in the ambient temperature. In this way the distance between the characters and the mask is varied. In such a construction using bimetals the problems of non-uniform quality and marring of the print media are resolved to a degree but the cost is substantially increased because of the use of bimetals. Accuracy in obtaining the desired results is low because the mask has been supported on one side.

What is needed is a small sized impact printer having a mask which prevents marring of the print media and assures uniform quality of print by automatic adjustments to compensate for variations in ambient temperature.

SUMMARY OF THE INVENTION

Generally speaking, in accordance with this invention, a small sized impact printer having a mask construction especially suitable for operation in varying ambient temperatures is provided. The printer mask has spaced openings to allow impact therethrough of a hammer against characters arranged in circular columns along a character drum. The distance between the characters and mask changes automatically to compensate for changes in ambient temperature by using mounting materials of selected thermal coefficients of expansion.

Difficulties arise generally as the character drum expands or contracts with increasing or decreasing temperature respectively. In one mounting, the mask is moved in the radial direction of the drum by means of a mounting which expands and contracts transversely to the character drum. In an alternative embodiment the mask is moved in a radial direction as a result of expansion of the mounting materials in a direction parallel to the longitudinal axis of the drum. A proper distance between the mask and the characters prevents marring of the print media during impact of the characters by the hammer and assures uniform printing quality regardless of the ambient temperature.

Accordingly, it is an object of this invention to provide an improved small sized impact printer having a mask which prevents marring of the paper regardless of the ambient temperature.

Another object of this invention is to provide an improved small sized impact printer wherein a mask moves toward or away from the character drum as the ambient temperature decreases or increases.

A further object of this invention is to provide an improved small sized impact printer wherein proper mask position is achieved by mounting the mask on the member using materials having a high coefficient of thermal expansion.

Still another object of this invention is to provide an improved small sized impact printer having an automatically adjusting mask which is easily preset in production for nominal operating conditions.

Yet another object of this invention is to provide an improved small sized impact printer having an automatically adjusting mask which needs no presetting in production.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a semi-schematic side view of a small sized impact printer with a mask of the prior art;

FIG. 2 is a sectional view taken along the line 2—2 of FIG. 1;

FIG. 3 is a view similar to FIG. 2 showing a printer construction without a mask;

FIGS. 4, 5 and 6 are views similar to FIG. 1 showing alternative embodiments of a small sized impact printer with a mask in accordance with this invention;

FIG. 7 is a plan view of the embodiments of FIG. 6 to a smaller scale;

FIG. 11 is a partial side elevational view of the printer in accordance with this invention of FIG. 10;

FIG. 12 is a top plan view of the printer of FIG. 11;

DESCRIPTION OF THE PREFERRED EMBODIMENTS

Figure 4:
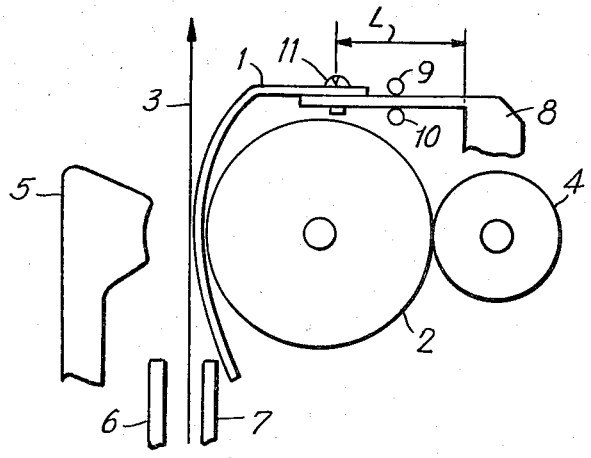

The small sized impact printer in accordance with this invention includes a member for positioning a mask relative to a character drum which uses an ink roller as the means for applying ink to the characters on the drum. This invention eliminates the defects in prior art impact printers whereby the print paper becomes dirty or marred and the printed characters are too light or too dark in color. This is accomplished by taking advantage of the temperature changes which, in fact, are the cause of the above-mentioned defects in performance.

With reference to FIGS. 1 and 2, a conventional impact printer includes a mask 1 positioned in relationship to a character drum 2. The mask 1 separates a print paper 3 from the character drum 2, but as best seen in FIG. 2, the mask is in the form of a lattice through which characters on the drum 2 are accessible to a hammer 5 located on the opposite side of the paper 3 from the drum 2. In the known manner, the characters on the character drum 2 are arranged in raised circular columns and printing of a line of characters on the paper 3 is accomplished by the hammer 5 striking a selected character on each column in sequence. Printing on the paper 3 is produced with ink which is applied to the raised characters of the character drum 2 by means of an ink roller 4 and them impacting the print paper 3 with the hammer 5. The paper 3 is then pressed against the inked character and is printed upon.

As seen in FIG. 2, the mask 1 causes a deflection of the paper 3 at the impacted character such that the paper 3 makes contact only with the character which is impacted instaneously by the hammer 5. Thus, the paper is not dirtied by ink on any other portion of the character drum and in particular by the linked characters in column which are not then being printed.

As shown in FIG. 3, when a mask is not provided for preventing the print paper from being marred, the paper is readily smeared with ink as the paper 3 is in contact with a plurality of characters in adjacent columns at the time of printing a selected character in one column. In order to prevent this malfunction, a mask 1 can be provided. However, a proper value of the distance S (FIG. 2) between the mask 1 and the character surfaces on the character drum 2 becomes an important criterion of design if the print paper 3 is to come into contact with only the character on the drum 2 which has been selected for printing, as shown in FIG. 2. Hitherto, several studies have been carried on searching for a suitable value for the distance S. The proper value for the distance S depends upon the printing energy in the impacting hammer, the type of print paper, the material from the which the character drum is fabricated, characteristics of the printing ink, the pitch distance between the columns of characters on the character drum and the ambient temperature, among other parameters which affect the distance S. Therefore, it is difficult to obtain the proper value of the distance S to satisfy all of these parameters.

The ambient temperature has an especially large influence upon the shade of color or intensity of the characters and the amount of marring or dirtying of the print paper. If the mask is set in relationship to the character drum so as to obtain the best printing quality at a selected design operating temperature, the print paper is readily dirtied and the printed characters become dark in color once the ambient temperature increases above the design temperature. This occurs because at the higher temperatures, ink flows more readily out of the ink roller such that the characters are increasingly wetted. Also, the character drum expands if it is fabricated of rubber or plastic. This expansion is radial and this expansion decreases the distance S. Furthermore, at elevated temperatures the mechanical load on the printer driving mechanisms becomes less because the lubricating oil flows more freely, friction is reduced and the impact energy of the hammer is increased. Thus, the higher temperatures cause a generation of dirt and marring on the print paper and the shade of color, that is, the intensity of the printed characters is increased beyond what is normally desirable.

On the other hand, when the ambient temperature drops below the design temperature, the diameter of the character drum is reached and the distance S increases. As a result, the printed characters become light in intensity and color and at worst, the printed characters are not completely printed. Thus, the change in ambient temperature and printing quality have a close relationship one to the other.

A small size impact printer in accordance with this invention eliminates these deficiences or defects in performance whereby the print paper no longer becomes dirty and the printed characters are no longer light or dark. Printing quality is also improved. In this invention, the distance S between the mask and the character surface is made larger at elevated temperatures and smaller at low temperatures relative to the design operating temperature by adapting the structure so that the position of the mask is made to move forward or back relative to the character drum in accordance with the changes in the ambient temperature. Thereby, the phenomena that the print paper is easily made dirty and the printing density is high at high temperature and low at low temperature is eliminated.

Conventionally, in the prior art, the mask is fixed in place by screwing down to a rigid portion of the printer, for example, the metal frame, at the normal design operating temperature. Thus, relatively speaking, the position of the mask is substantially fixed whereas the roller changes its dimensions with the changes in ambient temperature.

In an embodiment in accordance with this invention (FIG. 4), a material having a high coefficient of linear thermal expansion is used as a frame 8 for the printer. Similar parts in this embodiment in accordance with this invention have the same reference numerals as in FIGS. 1–3. The frame 8 extends out over the character drum 2 and the mask 1 is attached by means of a screw fastener 11 to the extended portion of the frame 8. The extended portion of the frame 8 has a length L from the main portion of the frame to the screw fastener 11. The distance L expands and contracts in accordance with changes in the ambient temperature and the distance between the mask 1 and the characters on the character drum 2 also changes because the frame 8 has a higher coefficient of expansion than does the mounting for the character drum 2. Although the character drum is also changing with temperature, good printing quality is obtained under any temperature conditions by proper selection of materials. Shafts 9, 10 are guide shafts for preventing the span L from warping when the temperature changes. Guides 6, 7 position the printer paper 3 relative to the character drum 2 and hammer 5. Satisfactory results have been obtained when the frame 8 is of plastic having the same coefficient of linear expansion as the drum 2, which is rubber or plastic.

Figure 5:
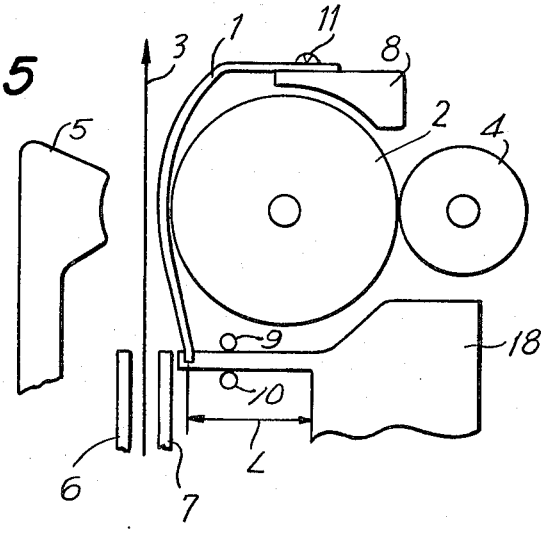

FIG. 5 is an alternative embodiment in accordance with this invention of a small sized impact printer. Herein, the lower extremity of the mask 1 is engaged in a frame 18 having an extended portion with a length L. The frame 18 is fabricated of material having a high coefficient of expansion similar to that of the drum 2, whereby the distance between the mask 1 and the character drum 2 varies in a manner appropriate to produce a high printing quality over a range of ambient temperatures. Thus, the same desirable effects as achieved in the embodiment of FIG. 4 are also achieved with the embodiment of FIG. 5.

In another alternative embodiment, (FIGS. 6,7) plastic rings 12, 13 are mounted coaxially with the character drum 2. These rings 12, 13 are in slight contact with the left and right edges (FIG. 7) of the mask 1. The mask is made to move toward and away from the character ring 2 because the plastic rings 12, 13 expand and contract in accordance with temperature changes in the same manner as did the frame members in the embodiments (FIGS. 4,5) above. In this construction, since the plastic rings 12, 13 are coaxial with the character drum 2, the design distance between the characters on the character drum 2 and the mask 1 is easily set. It is necessary that the mask 1 used in this construction has resiliency. Should the mask be rigid, the same effect is obtained by pressing the rigid mask against the surfaces of the plastic rings 12, 13 and mounting the mask using a resilient member.

As described above, in accordance with this invention, good printing quality is obtained by taking advantage of the changes in the ambient temperature which hitherto had only a bad influence on the printing quality of the printers. This invention is not limited to the embodiments described above but can be widely applied in other constructions relying on the temperature characteristics of primarily the character drum and mask mounting. Thereby, the inevitable disadvantages of the prior art printers using ink rollers, that is, variations in the intensity of the printing and a tendency to dirty the print paper, are eliminated.

Figure 8:
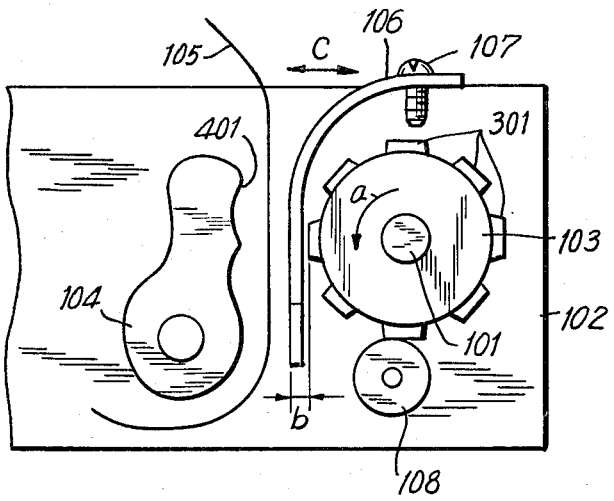
FIG. 8 PRIOR ART
FIG. 8 is a semi-schematic side elevational view of a small sized impact printer with a mask in accordance with the prior art.
Figure 9:
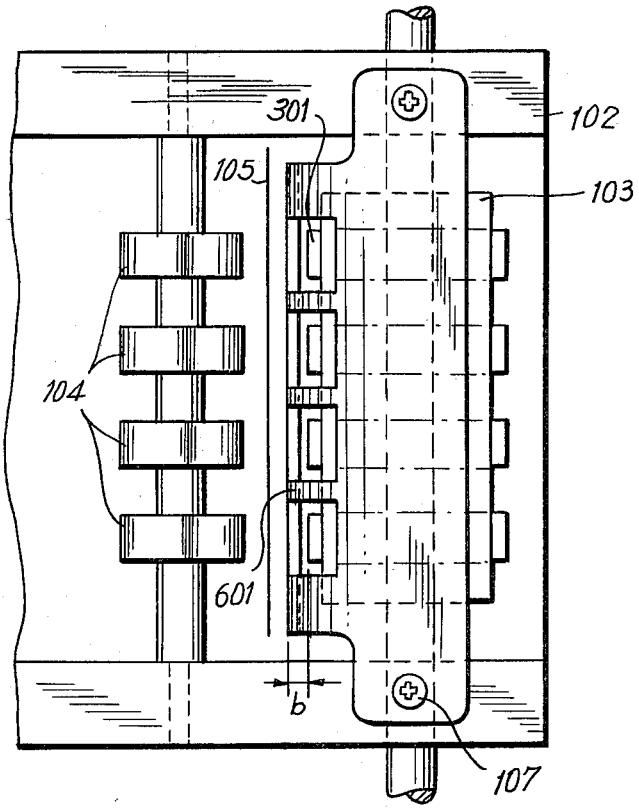
FIG. 9 PRIOR ART
FIG. 9 is a plan view of the small sized impact printer of FIG. 8.

The embodiments described above compensate for temperature changes by similar changes in the mask support in the radial direction of the character drum 2. However, this type of construction while resolving the problems of poor print quality and marring of the paper, may present difficulty in arrangement of parts. Alternative embodiments of a small sized impact printer in accordance with this invention are described with reference to FIGS. 10–15. FIGS. 8 and 9 show a printer in accordance with the prior art wherein a character drum shaft 101 is rotatably supported by a frame 102 and rotates in the direction indicated by the arrow a. A character drum 103 is mounted for rotation with the character drum shaft 101 and includes a plurality of columns of characters 301 on the periphery of the drum 103. An ink roller 108 transfers ink to the characters 301 as they rotate in a coventional manner. A multiple hammer 104 is provided for striking the characters 301 through a print paper 105 and through the openings of a mask 106 having portions 601 positioned between the character columns 301 and having a shape similar to the teeth of a comb.

When the desired characters 301 are rotated by rotation of the character drum shaft 101 to a position for printing, that is, a position corresponding with the striking surfaces 401 of the hammers 104, the hammers 104 are driven with the proper timing to print the character. The hammers 104 are combined in an integral member and all hammers strike simultaneously so that a line of characters are simultaneously printed on the printer paper 105. It should be noted that in the prior art embodiment of FIGS. 1–3, a single hammer moves sequentially from column to column of characters printing one character at a time. As in the prior art of FIGS. 1–3, if a mask 106 is not provided at the time of impact when a character is printed in one column, the print paper 105 is dirtied by ink on an adjacent character because the print paper 105 touches the adjacent characters 301 on the character drum 103. The mask 106 prevents the print paper 105 from touching the characters 301 which are not being printed so that the paper does not become marred with ink.

When the distance b between the surface of the characters 301 and the surfaces of the mask 106 is small, the paper 105 is apt to become marred with ink. When the distance b is made large, the print paper 105 does not reach the character 301 on the character drum 103 when the hammer 104 advances to the character drum 103. Thus, there are conditions related to the distance b under which normal printing cannot be effectively accomplished. Accordingly, in order to control the distance b, it is necessary to make fine adjustments to the mask 106 in the radial direction of the character drum 103 as indicated by the arrow c. The need to make these fine adjustments during the assembly process increases the number of assembly steps substantially and increases the cost of production. Further, as stated above with reference to FIGS. 1–3, when the mask 106 is finely adjusted at a normal design operating temperature and is fixed in place by a screw 107, the distance b changes because of expansion of the character drum 103 when the temperature is substantially elevated above the design operating temperature. Thus, the print paper 105 becomes dirtied during the process of printing. There is also a disadvantage at high temperatures that the ink viscosity is lowered and the ink is apt to attach to the paper more readily with the result that the paper is easily made to appear smudgy and dirty.

Figure 10:
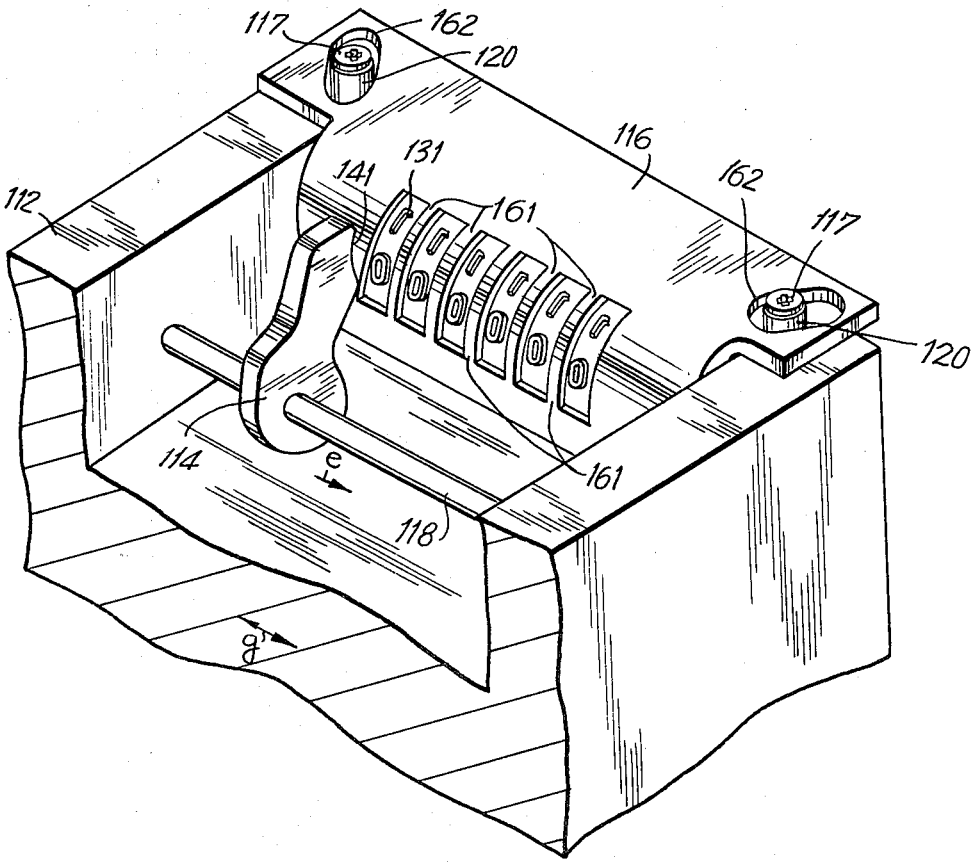
FIG. 10 is a top perspective view of a small sized printer in accordance with this invention.

On the other hand, when the temperature is substantially below the design operating temperature, printing becomes difficult to accomplish or the print character becomes light in color or density to an extreme degree, because the distance b is enlarged by a contraction of the character drum 103. Also, the ink may become hardened at the low temperature to further compound the problem. The printers in accordance with this invention eliminate the disadvantages of the prior art by automatically controlling the position of the mask so that the distance between the mask and the character drum can be enlarged at high temperatures and reduced for the low temperature range. FIG. 10 is a perspective view of an alternative embodiment of a small sized impact printer in accordance with this invention. With reference to FIGS. 10–12, a printer frame 112 is made of plastic. A character drum shaft 111 is rotatably supported by the frame 112 and rotates in the direction indicated by the arrow d. A character drum 113 is mounted for rotation with the character drum shaft 111 and includes a plurality of columns of characters 131 on the periphery. An ink roller 119 transfers ink to the characters 131 in the conventional manner. A hammer 114 strikes the characters 131 through a print paper 115. The hammer 114, when actuated, pivots around a hammer shaft 118 to strike the characters 131 through a mask 116 having portions 161 located at the positions between the columns of characters 131. As best seen in FIG. 10, the mask portions 161 form a grid similar to the teeth of a comb.

Elliptically-shaped holes 162 are located on both ends of the mask 116, and a thick circular washer 120 is fixed on each side of the frame 112 by a screw 117 with the washers 120 passing through the elliptical holes 162.

In this construction, when a desired character 131 of a first column is rotated to a printing position, that is, a position corresponding with the striking surface 141 of the hammer 114, printing is accomplished by driving the hammer 114 with appropriate timing. After the first column has been printed, the hammer 114 is translated by conventional means (not shown) in the direction indicated by the arrow e so that the hammer position corresponds with the printing position for the second column of characters 131. Then, in a similar manner as with the first column, the desired character is printed in the second column, and so forth until characters of all columns are printed. If the mask 116 is not provided at the time of printing, the print paper 115 touches characters 131 on the character drum 113 adjacent to the character which is being printed and the print paper 115 becomes dirty due to ink attached to the characters 131 in the adjacent columns. The mask 116 prevents the touching of the print paper 115 against characters 131 in adjacent columns which are not being printed at the moment and the print paper does not become dirty. As stated above, it is extremely important to have an optimal distance f between the surface of the characters 131 and the surface of the mask 116. The distance f tends to be reduced by expansion of the character drum 113 at elevated temperatures and becomes larger by contraction of the character drum 113 at low temperatures. Because of the flow characters of the ink, there is also the problem that the print paper is dirtied at high temperatures because the ink flows more freely, and the printed characters are light in color at the low temperatures because the ink hardens. However, these problems are resolved in this embodiment in accordance with this invention as follows.

One end of the mask (FIG. 11) is inserted into a groove 121 provided in the frame 112 and the mask 116 can pivot at this end. The mask 116 is adjusted so that the distance f is at a suitable magnitude and is tightened by the screw 117 at a suitable position for the design operating temperature. The screws 117 do not directly fix the mask 116 to the frame 112, but rather fix the washers 120 for mask adjustment to the frame 112. Accordingly, the distance f can be maintained at a constant value even if a force, for example, to reduce the distance f, is applied to the mask 116. This result is achieved by the inclined plane 163 of the elliptical hole 162 which abutts against the washer 120 for mask adjustment although the mask 116 per se is not tightened by screws.

When characters are printed with such a mask there is no problem of marring the paper and print quality is good.

Figure 13:
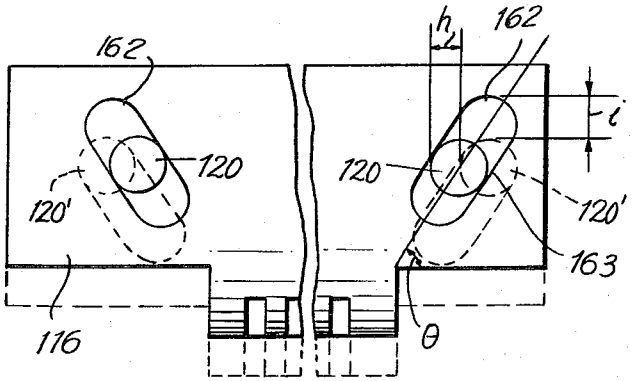
FIG. 13 is a plan view of the mask portion of the printer of FIG. 10, showing the effects of temperature change.
Figure 14:
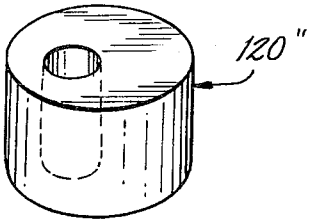
FIG. 14 is a washer suitable for use with the mask of FIG. 13.

The frame 112 is made of a plastic material which has a greater coefficient of linear thermal expansion than the mask 116 which is fabricated of a more temperature stable material, for example, stainless steel and the like. At high temperatures, frame 112 expands in a lateral direction as indicated in FIG. 12 by the arrow g. As the frame 112 increases in length, the washers 120 which are fixed to the frame 112 inevitably move further apart. This condition of high temperature is illustrated in FIG. 13. The solid lines show the conditions at normal temperature and the broken lines show the conditions at an elevated temperature with the washers 120' moved further apart from their original positions. The mask 116 is substantially unchanged dimensionally and certainly is less changed than is the frame 112. When the washers 120 for mask adjustment move by a distance h, the inclined surfaces 163 of the elliptical holes 162 on the mask 116 are pushed by the washers 120 such that the mask 116 is displaced by a distance i. This displacement of the mask 116 is in a direction transverse to the direction of the arrow g (FIG. 12) and the displacement h (FIG. 13). The displacement i is in a direction paralleling the radial extension of the character drum 113 toward the hammer 114. Assuming that the angle of inclination of the elliptical holes 162 is $\theta$ relative to the longitudinal axis of the shafts 111, 118, the relationship between the transverse displacement distance i and the angle of inclination $\theta$ is $i=h \tan \theta$. Because h depends on the thermal characteristics of the selected frame material, the amount of displacement of the mask 116 toward or away from the character drum 113 depends upon the magnitude of the angle $\theta$. Thus, when using a selected material, a desirable compensation distance i can be selected by selecting a proper angle $\theta$.

As stated above, as the mask 116 moves by the distance i at high temperature, the distance f between the mask 116 and the character drum 113 does not change at the high temperature when the character drum also enlarges radially by a similar amount. However, the distance f can be made larger at the high temperatures if desired to compensate for the changed characteristics of the ink. Accordingly, the print paper does not become dirty at the time of printing at high temperature.

At low temperatures, the movements are the opposite to those which occur at high temperature. However, the principles of operation are the same for low and high temperatures and a detailed explanation is not again warranted. At low temperatures, the mask 116 is moved in a direction toward the character drum whereby the distance f is maintained the same, or if desirable the distance f is made less at the lower temperature to compensate for the changing characteristic of the ink and to avoid printing characters which are light in color or intensity. Thus, printing quality over a range of temperatures is improved and the paper is not marred over this temperature range. In accordance with this embodiment, displacement of the frame 112 in a lateral direction, that is, parallel to the shafts 111, 118 result in a displacement of the mask in a transverse direction, that is, in a direction of the radius of the character drum 113. In the embodiments of FIGS. 4–7, displacements due to temperature in the radial direction were utilized for compensation in the position of the mask.

In an alternative embodiment of a small sized impact printer in accordance with this invention, washers 120'' (FIG. 14) are used in place of the circular washers 120 previously described. The hole in the washer 120'' is somewhat larger in diameter than is the diameter of the screw 117 which passes through the hole. With this construction, it is possible to fix the mask 116 at the desired proper position by rotating the eccentric washer 120''. When the washer 120'' and the mask 116 are at the desired position, the screw 117 is tightened to hold that condition. Thereby, fine adjustment of the mask 116 relative to the character drum 113 is readily possible and assembly of the printer becomes easy.

Furthermore, when the accuracy in production of the parts associated with the washers 120, 120'' is high, these washers for mask adjustment can be formed integrally with the frame 112 and a substantially constant value of the distance f can be achieved without any adjustment. The positional changes of the mask in accordance with the temperature variations is automatically compensated in the same manner as described above. In this construction, the number of parts is decreased and adjustment at the design temperature of operation is unnecessary.

Figure 15:
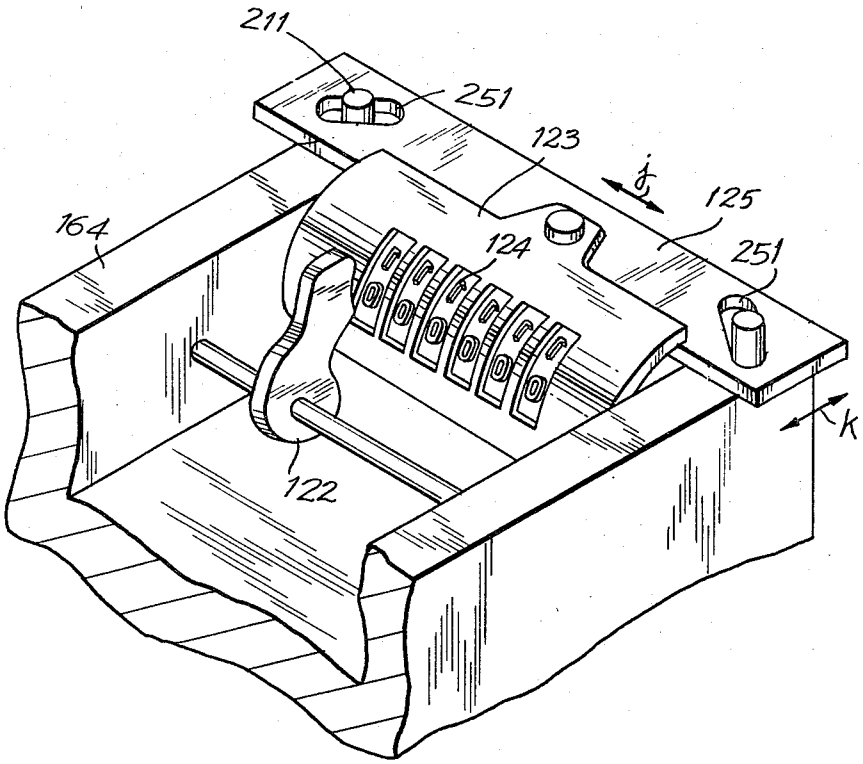
FIG. 15 is top perspective view of a portion of an alternative embodiment of a small sized impact printer in accordance with this invention.

FIG. 15 shows another alternative embodiment of a small sized impact printer in accordance with this invention. The printer includes a metallic frame 164, hammer 122, mask 123, and characters 124 provided on a character drum. A temperature controlling member 125 is mounted on the frame. Since the method of printing is the same as that in the printer of FIG. 10, the printing method is not described again here. The temperature controlling member 125 is fabricated of a material, for example, a plastic material, having a large coefficient of linear expansion relative to the thermal characteristics of the metallic frame 164. The temperature controlling member 175 expands and contracts in the directions indicated by the arrow j. Elliptical holes 251, having a fixed inclination are provided on the opposite ends of the temperature controlling member 125 and projections 211 from the frame 164 extend through the elliptical holes 251. A fit is provided between the elliptical holes 251 and the projections 211 such that expansion and contraction of the temperature controlling member 125 in the directions j causes the temperature controlling member 125 to be displaced in the transverse directions indicated by the arrow k. The temperature controlling member 125 is connected to the mask 123 and movements of the temperature controlling member 125 in the direction of the arrow k serves to move the mask 123 by a similar distance in the same direction. Thus, it is possible to have the distance between the character 124 and the mask 123 be larger when the temperature is high and be smaller when the temperature is low so as to compensate for the changes in characteristics of the ink. Obviously, the distance between the characters 124 and the mask 123 can be made substantially constant over the range of operating temperatures if it is so desired. With these automatic adjustments the printed characters are of high quality at all temperatures and the paper is not marred or dirtied. Note that the elliptical openings are oppositely inclined when comparing the embodiments of FIGS. 12 and 15.

It should be apparent that similar motions of the mask can be achieved in alternative embodiments of a printer in accordance with this invention, when the washers 120, 120'' are connected to the members 116, 125 respectively and inclined elliptical recesses are formed in the frames 112, 164 respectively.

The use of a mask which automatically adjusts for changes in ambient temperature so that the print quality is high over the entire temperature operating range has resulted in significant improvements in printer performance.

It will thus be seen that the objects set forth above, among these made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an impact printer of the character drum type including a character drum having peripheral characters thereon, said drum being mounted on a shaft for rotation therewith about the longitudinal drum axis, the radius of said drum being variable with temperature, an ink roller for supplying ink to said characters, at least one hammer for selectively impacting characters on said drum, means for positioning a print medium between said characters and said at least one hammer, the improvement therein comprising:

a mask interposed between said drum and said at least one hammer, said mask having at least an opening wherethrough said at least one hammer, when actuated, impacts a selected character on said drum;

a frame having at least one projection and supporting said drum shaft;

means for positioning said mask at a selected position relative to said drum, said means for positioning being connected to said mask and having at least one inclined plane in sliding engagement with said frame projection, said means for positioning expanding or contracting in the direction transverse to the radius of said drum in response to increase or decrease respectively in ambient temperature, said at least one inclined plane sliding relative to said at least one projection and moving said means for positioning in the direction of the radius of said drum in response to said transverse expansion and contracting of said means for positioning, said mask moving with said means for positioning in the direction of the radius of said drum in response to said expansion and contraction of said means for positioning.

2. An impact printer as claimed in claim 1, wherein said frame is dimensionally temperature stable relative to said means for positioning and said character drum.

3. In an impact printer of the character drum type including a character drum having peripheral characters thereon, said drum being rotatably mounted on a frame, the radius of said drum being variable with temperature, an ink roller for supplying ink to said characters, at least one hammer for selectively impacting characters on said drum, means for positioning a print medium between said characters and said at least one hammer, the improvement therein comprising:

a mask interposed between said drum and said at least one hammer, said mask having at least one inclined plane and having at least an opening wherethrough said at least one hammer, when actuated, impacts a selected character on said drum;

means for positioning said mask at a selected position relative to said drum, said means for positioning expanding or contracting in the direction transverse to the radius of said drum in response to increase or decrease respectively in ambient temperature;

means for converting motion, including at least one washer connected to said means for positioning and slidingly engaged with said inclined plane of said mask, said means for converting motion changing the direction of said transverse motion of expanding and contracting of said means for positioning by relative motion between said inclined plane and at least one washer, said mask moving in the direction of the radius of said drum in response to said expanding and contracting.

4. An impact printer as claimed in claim 3, wherein said means for positioning is said frame.

5. An impact printer as claimed in claim 4, and further comprising a shaft, said character drum being mounted for rotation about the longitudinal drum axis on said shaft, said shaft being supported by said frame.

6. An impact printer as claimed in claim 5, wherein said mask is dimensionally stable as compared to said frame, and said at least one washer is connected to said frame, expansion and contraction of said frame causes said at least one washer to move with said frame in said transverse direction and slide on said at least one inclined plane, said mask being moved in said radial direction.

7. An impact printer as claimed in claim 6, wherein said at least one inclined plane is inclined to the axis of said shaft.

8. An impact printer as claimed in claim 7, wherein said inclined plane is a side wall of an elliptical hole in said member, and said washer rides in said hole.

9. An impact printer as claimed in claim 6, wherein said washer is integral with said frame.

10. An impact printer as claimed in claim 6, and further comprising a fastener, said fastener releasably connecting said washer to said frame, said fastener when loosened permitting eccentric rotation of said washer relative to said frame, and said selected position of said mask relative to said drum is set by selecting and fixing with said fastener the rotational position of said washer against said inclined plane.

11. An impact printer as claimed in claim 10, wherein said inclined plane is a side wall of an elliptical hole in said member, and said washer rides in said hole.

12. An impact printer as claimed in claim 4, wherein said frame is made of plastic.

13. An impact printer as claimed in claim 3, wherein said inclined plane is a side wall of an elliptical hole in said mask, and said washer rides in said hole.

14. In an impact printer of the character drum type including a character drum having peripheral characters thereon, the radius of said drum being variable with temperature, an ink roller for supplying ink to said characters, at least one hammer for selectively impacting characters on said drum, means for positioning a print medium between said characters and said at least one hammer, the improvement therein comprising:

a shaft and a frame, said character drum being mounted for rotation about the longitudinal drum axis on said shaft, said shaft being supported by said frame;

a mask interposed between said drum and said at least one hammer, one portion of said mask being fixed on said frame, said mask having at least one opening wherethrough said at least one hammer, when actuated, impacts a selected character on said drum;

means for positioning mounted on said shaft, said means for positioning expanding or contracting in the direction of the radius of said drum in response to increase or decrease respectively in ambient temperature, said means for positioning being engaged with another portion of said mask, said mask moving in the direction of the radius of said drum in unison with said means for positioning.

15. An impact printer as claimed in claim 14, wherein said means for positioning includes at least one disk mounted on said shaft, said at least one disk extending radially from said shaft to contact said mask, the radius of said disk determining the magnitude of said spacing between said drum and said mask.

16. An impact printer as claimed in claim 15, wherein said disk is fabricated of plastic.

17. An impact printer as claimed in claim 15, wherein said means for positioning and said character drum have substantially equal coefficients of linear thermal expansion, whereby a spacing between said drum and said mask set at said selected position is substantially maintained over a range of operating temperatures.

18. An impact printer as claimed in claim 14, wherein said means for positioning has a greater coefficient of linear thermal expansion than does said character drum, whereby a spacing between said drum and said mask set at said selected position increases as temperature increases and decreases as temperature decreases.

* * * * *

UNITED STATES PATENT AND TRADEMARK OFFICE

CERTIFICATE OF CORRECTION

PATENT NO. : 4,402,261

DATED : September 6, 1983

INVENTOR(S) : Chihiro Ohtsuki, Hitoshi Mikoshiba

It is certified that error appears in the above—identified patent and that said Letters Patent is hereby corrected as shown below:

On cover page, on the line after "Primary Examiner Edward M. Coven" insert --Attorney, Agent, of Firm - Blum, Kaplan, Friedman, Silberman and Beran--

Signed and Sealed this

Eighth Day of February, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,402,261

DATED : September 6, 1983

INVENTOR(S) : Chihiro Ohtsuki, Hitoshi Mikoshiba

It is certified that error appears in the above-indentified patent and that said Letters Patent is hereby corrected as shown below:

On the title page, the Assignee should read as follows:

[73] Assignee: Kabushiki Kaisha Suwa Seikosha, Tokyo, Japan and Epson Corporation, Nagano-Ken, Japan.

Signed and Sealed this

Thirty-first Day of May, 1994

Bruce Lehman

*Attest:*

BRUCE LEHMAN

*Attesting Officer*

*Commissioner of Patents and Trademarks*